US009441454B2

(12) United States Patent
Broussard et al.

(10) Patent No.: US 9,441,454 B2
(45) Date of Patent: Sep. 13, 2016

(54) GRAVEL PACK APPARATUS HAVING ACTUATED VALVES

(71) Applicant: Weatherford/Lamb, Inc., Houston, TX (US)

(72) Inventors: John P. Broussard, Kingwood, TX (US); Christopher A. Hall, Cypress, TX (US); Ronald van Petegem, Montgomery, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 620 days.

(21) Appl. No.: 13/738,713

(22) Filed: Jan. 10, 2013

(65) Prior Publication Data

US 2014/0116693 A1 May 1, 2014

Related U.S. Application Data

(63) Continuation-in-part of application No. 13/661,710, filed on Oct. 26, 2012.

(51) Int. Cl.

| | |
|---|---|
| ***E21B 34/06*** | (2006.01) |
| ***E21B 43/04*** | (2006.01) |
| ***E21B 43/08*** | (2006.01) |
| *E21B 34/00* | (2006.01) |

(52) U.S. Cl.

CPC ..... *E21B 34/06* (2013.01); *E21B 43/045* (2013.01); *E21B 43/08* (2013.01); *E21B 2034/002* (2013.01); *E21B 2034/007* (2013.01)

(58) Field of Classification Search

CPC ..... E21B 34/06; E21B 34/066; E21B 34/14; E21B 34/10; E21B 43/04; E21B 43/045; E21B 43/08; E21B 43/082; E21B 43/084; E21B 43/086; E21B 43/088; E21B 21/12; E21B 2034/002; E21B 2034/005; E21B 2034/007

See application file for complete search history.

(56) References Cited

U.S. PATENT DOCUMENTS

| | | | | |
|---|---|---|---|---|
| 7,147,054 | B2 | 12/2006 | Wang et al. | |
| 7,661,476 | B2 | 2/2010 | Yeh et al. | |
| 2007/0187095 | A1 | 8/2007 | Walker et al. | |
| 2009/0025923 | A1* | 1/2009 | Patel | E21B 43/045 166/51 |
| 2010/0163235 | A1 | 7/2010 | Mootoo | |
| 2010/0230098 | A1 | 9/2010 | Craig | |
| 2013/0062066 | A1* | 3/2013 | Broussard et al. | 166/305.1 |
| 2015/0068743 | A1* | 3/2015 | Broussard et al. | 166/278 |

FOREIGN PATENT DOCUMENTS

| | | | |
|---|---|---|---|
| EP | 0482930 | A2 | 4/1992 |
| EP | 1225302 | A2 | 7/2002 |
| WO | 2008/070271 | A2 | 6/2008 |

(Continued)

OTHER PUBLICATIONS

Dictionary definition of "valve", accessed Jun. 3, 2015 via thefreedictionary.com.*

Search Report in counterpart European Appl. 13190286.8, dated Jun. 30, 2014.

(Continued)

*Primary Examiner* — Blake Michener

(74) *Attorney, Agent, or Firm* — Blank Rome LLP

(57) ABSTRACT

A device and method allows a bore valve in the washpipe and in certain instances a port valve or sliding sleeve to open or close upon command from the surface so that gravel slurry may be placed in a wellbore.

23 Claims, 2 Drawing Sheets

(56) References Cited

FOREIGN PATENT DOCUMENTS

| | | | |
|---|---|---|---|
| WO | 2009/015109 | A1 | 1/2009 |
| WO | 2010/127457 | A1 | 11/2010 |
| WO | 2012/037646 | A1 | 3/2012 |

OTHER PUBLICATIONS

First Examination Report in counterpart Australian Appl. 2013248172, dated May 6, 2015.
First Office Action in counterpart Canadian Appl. 2,830,393, dated Oct. 8, 2014.

* cited by examiner

GRAVEL PACK APPARATUS HAVING ACTUATED VALVES

CROSS-REFERENCE TO RELATED APPLICATIONS

This is a continuation-in-part of U.S. application Ser. No. 13/661,710, filed 25 Oct. 2012, and entitled "RFID Actuated Gravel Pack Valves," which is incorporated herein by reference in its entirety.

BACKGROUND

Hydrocarbon wells, horizontal wells in particular, typically have sections of wellscreens with a perforated inner tube and an overlying screen portion. The purpose of the screen is to block the flow of particulate matter into the interior of the perforated inner tube, which connects to production tubing. Even with the wellscreen, some contaminants and other particulate matter can still enter the production tubing. The particulate matter usually occurs naturally or is part of the drilling and production process. As the production fluids are recovered, the particulate matter is also recovered at the surface. The particulate matter causes a number of problems in that the material is usually abrasive reducing the life of any associated production equipment. By controlling and reducing the amount of particulate matter that is pumped to the surface, overall production costs are reduced.

Even though the particulate matter may be too large to be produced, the particulate matter may cause problems downhole at the wellscreens. As the well fluids are produced, the larger particulate matter is trapped in the filter element of the wellscreens. Over the life of the well as more and more particulate matter is trapped, the filter elements will become clogged and restrict flow of the well fluids to the surface.

A method of reducing the inflow of particulate matter before it reaches the wellscreens is to pack gravel or sand in the annular area between the wellscreen and the wellbore. Packing gravel or sand in the annulus provides the producing formation with a stabilizing force to prevent any material around the annulus from collapsing and producing undesired particulate matter. The packed gravel also provides a prefilter to stop the flow of particulate matter before it reaches the wellscreen.

In typical gravel packing operations, a screen and a packer are run into the wellbore together. Once the screen and packer are properly located, the packer is set so that it forms a seal between wellbore and the screen and isolates the region above the packer from the region below the packer. The screen is also attached to the packer so that it hangs down in the wellbore, which forms an annular region around the exterior portion of the screen. The bottom of the screen is sealed so that any fluid that enters the screen must pass through the screening or filtering material. The upper end of the screen is usually referred to as the heel and the lower end of the screen is usually referred to as the toe of the well.

Once the screen and packer are run into the wellbore but before they are run to their intended final location, a washpipe subassembly is put together at the surface and is then run downhole through the packer and into the screen. The run-in continues until a crossover tool on the washpipe subassembly lands in the packer. The entire assembly is then ready to be run into the wellbore to its intended depth.

Once the assembly of the screen, packer, washpipe, and crossover tool reaches its intended depth in the wellbore, a ball is pumped downhole to the crossover tool. The ball lands on one of two seats in the crossover tool. Once the ball lands on the first seat, pressure is applied from the surface across the ball and seat to set the packer and to shift a sleeve in the crossover tool. With the sleeve open, fluid, typically gravel slurry, may be pumped down the well through the washpipe. Physical manipulation of the crossover tool by raising the washpipe is required to position it properly relative to the screen and packer assembly so that fluid circulation can take place. When the slurry reaches the crossover tool, the gravel slurry is blocked by the ball and seat that was previously landed in the crossover tool. Instead, the ball and seat causes the gravel slurry to exit the crossover tool through a port that directs all fluid flow from inside of the washpipe above the packer to the outside of the washpipe and screen below the packer and into the annular space outside of the screen.

As the slurry travels from the heel of the well toward the toe along the outside of the screen, an alpha wave begins that deposits gravel from the heel towards the toe. All the while, the transport fluid that carries the gravel in the slurry drains inside through the screen. As the fluid drains into the interior of the screen, it becomes increasingly difficult to pump the slurry down the wellbore. Once a certain portion of the screen is covered, the gravel starts building back from the toe towards the heel in a beta wave to completely pack off the screen from approximately its furthest point of deposit towards the heel. As the gravel fills back towards the heel, the pressure in the formation increases.

The crossover tool has a second port that allows fluid to flow from the interior area of the screen below the packer to an annular area around the exterior of the washpipe but above the packer.

After the annular area around the screen has been packed with gravel, the crossover tool is again moved relative the screen and packer assembly to allow for fluid circulation to remove any slurry remaining in the washpipe above the packer. The flushed slurry is then disposed of at the surface. Then, a second ball may be pumped down the well to land in a second ball seat in the crossover tool. After the second ball has seated, pressure is applied from the surface to shift the sleeve in the crossover tool a second time as well as to seal off the internal bore of the crossover tool and to open a sleeve in a second location. Once the sleeve is shifted and is sealed in a second location, wellbore fluid from the surface flowing through the washpipe may be directed into an internal flowpath within the crossover tool and then back into the interior of the washpipe, thereby bypassing both the first and the second balls and seats. Once the fluid has been redirected to stay in the washpipe, the operator may reposition the washpipe and begin to acidize or otherwise treat the wellbore.

In the current system, fluid flow through the interior is limited by forcing the fluid to travel through a micro-annulus, which is the only path available in crossover tool. The only alternative is to reverse the washpipe and crossover tool completely out of the hole and run-in with an unobstructed washpipe. The additional trip out of the hole and then back in leads to additional time and expense in completing the well.

SUMMARY

In a system according to the present disclosure, neither dropping various balls to land on seats nor making a second trip into and out of the well is necessary to treat the well. The system reduces the time to accomplish well operations and improves fluid flow through the interior of the washpipe.

In the system, controlling the fluid flow is achieved by replacing the balls and seats that were previously necessary to alter the flow paths with a valve and port system. This valve and port system uses a valve and ports that may be operated on demand using pressure pulses or a radio frequency identification device. In such an embodiment, any type of valve that can open and close off flow through a tubular may be used, such a butterfly or ball valve.

By operating the valve and port system on demand, the operator can close off the interior of a washpipe tool, while opening flow through a port for gravel packing the wellbore. When the gravel packing is complete, the operator may then open the interior of the washpipe tool to flow from the casing and into the washpipe. This flow removes excess sand slurry from the washpipe in a reverse circulating process. Once sufficient reverse circulation has been performed, the port allowing the reverse circulation as well as the flow through port can be closed by operating valves. At this point, a port system can be opened to realize improved flow through the interior of the washpipe without having to run out of and then back into the wellbore.

DETAILED DESCRIPTION

Figure 1:
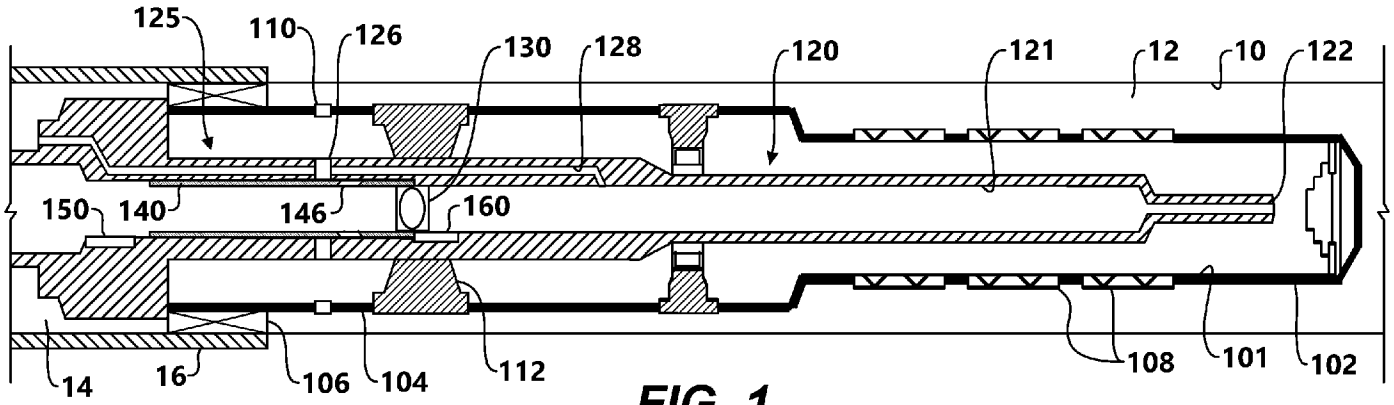
FIG. 1 depicts a wellbore having a screen assembly in a well and having a washpipe tool run into the screen assembly.

FIG. 1 depicts a screen assembly 100 located in a wellbore 10. The bottom or toe of the assembly 100 is designated at 102, and the upper end or heel of the assembly 100 is designated at 104 near casing 16. The sealing element 104 engages inside the wellbore 10 to restrict flow through an annular area 12. In particular, the sealing element 104 is set so that the sealing element 104 seals the screen assembly 100 in the wellbore 10 and forms the annular area 12 between the wellbore 10 and the screen's exterior. The sealing element 106, while typically a packer, may or may not have slips depending upon the wellbore 10 and the operator's requirements.

An inner workstring or washpipe tool 120 has been run into the downhole screen assembly 100. The washpipe tool 120 includes a crossover tool 125 and stings through the bore of the sealing element 106 and seals on the interior bore of the element 106 with at one or more seals or seats 112. The crossover tool 125 may be configured to allow fluid to flow down through the washpipe's main bore 121. Alternatively, the crossover tool 125 may be configured to divert flow out through one or more outlet ports 126 on the tool 125 with the return fluid being able to pass through an interior passageway 128. A bore valve 130 is disposed in the crossover tool 125. As shown in FIG. 1, the bore valve 130 is in an open condition to allow fluid to flow through the main bore 121 of the washpipe 120. The bore valve 130 can be a butterfly valve or a ball valve, although any other type of valve mechanism can be used.

The outlet port 126 is located downhole from sealing element 106. In general, the outlet port 126 may or may not have a port valve 140 for opening and closing the outlet port 126. For example, the port valve 140 can be a sliding sleeve movable to expose or isolate the outlet port 126 for fluid flow. In FIG. 1, the crossover tool 125 does include an internal port valve 140, shown here as a sliding sleeve 140 having a bypass port 146. When the sliding sleeve 140 is in a closed condition with its bypass port 146 closed relative to the outlet port 126, fluid is prevented from flowing out of the crossover tool 125, through the bypass port 146, out the outlet port 126 in the screen assembly 100, and into the annular area 12 between the screen assembly 100 and the wellbore 10. The port valve 140 can use any other type of valve mechanism available in the art to control fluid flow through the outlet port 126.

The crossover tool 125 further includes a signal receiver 150 and an actuator 160 disposed thereon. Depending on the type of electronics used, the signal receiver 150 can detect pressure pulses, radio frequency identification devices, or other signals communicated from the surface. In response to a received signal by the receiver 150, the actuator 160 performs an appropriate action to configure the crossover tool 125 for different operations, as described below. The actuator 160 can use any of a number of suitable components, such as a linear or rotary actuating mechanism, and can have a power source, electronics, and other components, which are not detailed herein but would be appreciated by one skilled in the art having the benefit of the present disclosure.

Figure 2:
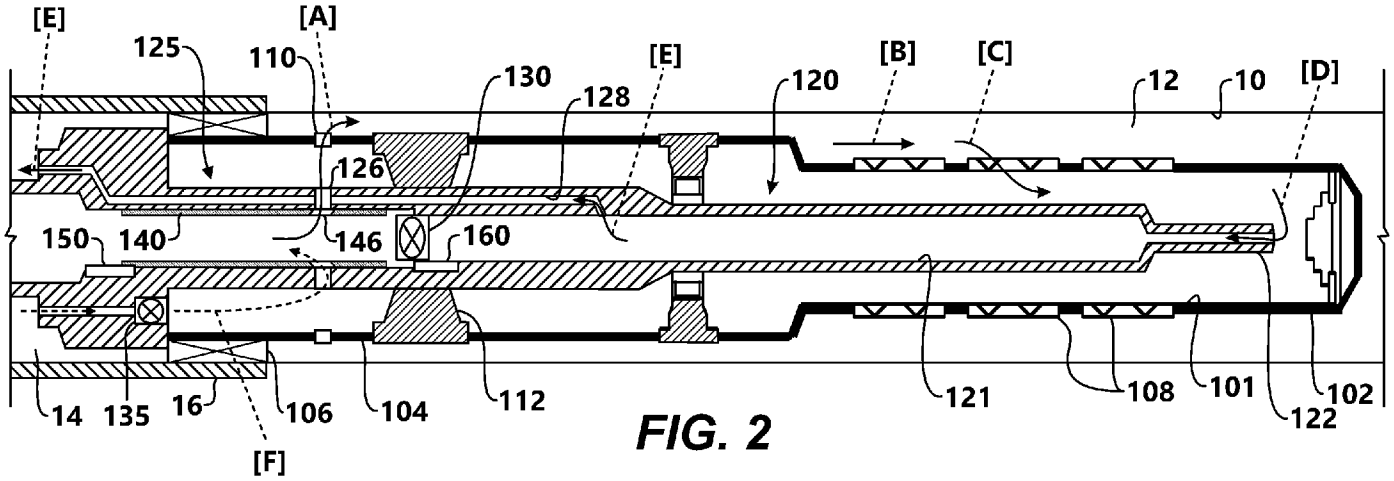
FIG. 2 depicts the crossover of the washpipe tool with a bore valve closed and with a port valve opened.

Prior to commencing a gravel packing operation, the crossover tool 125 is changed from its run-in configuration of FIG. 1 to a gravel packing configuration as depicted in FIG. 2. A signal is sent from the surface (not shown) downhole to the crossover tool 125 by a pressure pulse, a radio frequency identification device (not shown), or any other known means. Once the signal receiver 150 obtains the proper signal to reconfigure the crossover tool 125, power is supplied, typically by the actuator 160, so that the bore valve 130 is moved from an open condition to a closed condition so that fluid flow through the interior bore 121 of the washpipe 120 is prevented. Based upon the same or a different signal the signal receiver 150 receives, power is supplied by the actuator 160 to move the second valve or sliding sleeve 140, thereby opening the bypass ports 146 to allow fluid to flow from the interior bore 121 of the washpipe 120 through the outlet ports 126 in the screen assembly 100 and into the annular area 12.

The actuator 160 can supply power to both the sliding sleeve 140 and the bore valve 130 to either open or close the sliding sleeve 140 and the bore valve 130. In certain embodiments, two or more actuators 160 can be utilized to power the bore valve 130 and sliding sleeve 140 independently. As noted above, the actuator 160 can be any type known in the industry including rotary or linear actuators.

Once the crossover tool 125 is configured, gravel slurry (not shown) is pumped down the washpipe tool 120. The slurry exits the ports 146 and 126 and takes the path of least resistance (as indicated by directional arrow A) and flows out 110 towards the toe 102 of the annulus 12 (as indicated by directional arrow B). As the gravel slurry moves towards the toe 102 of the annulus 12, the fluid portion of the gravel slurry flows through screens 108 into the interior 101 of the screen assembly 100 (as indicated by directional arrow C). As the fluid flows into the interior 101 of the screen assembly 100, the gravel is deposited or "packed" around the exterior of the screen assembly 100.

The fluid returns passing into the assembly 100 then flow in to the interior 121 of the washpipe 120 through port(s) 122 (as indicated by directional arrow D). The fluid continues upward through the washpipe 120 to the crossover tool 125 where the fluid enters the interior passageway 128 (as indicated by directional arrow E). The fluid bypasses the closed bore valve 130 and exits the crossover tool 125 into an annular area 14 uphole of the assembly's sealing element 106.

After the gravel packing operation is complete, it may be desirable to circulate out excess slurry from the washpipe tool 120. To do this, the washpipe tool 120 can be reconfigured for reverse circulation. In general, the crossover tool 125 and washpipe tool 120 can be lifted from the sealing element 106 to allow fluid flow in the casing annulus 14 to flow into the washpipe's bore 121 through the ports 126 and back up the washpipe tool 120.

Alternatively, the washpipe tool 120 is not lifted and is instead reconfigured by sending a second signal to the signal receiver 150. Once the signal receiver 150 receives the proper signal to reconfigure the crossover tool 125, power is supplied by the one or more actuators 160 so that another valve (e.g., 135) is moved from a closed condition to an open condition so fluid is allowed to flow from the casing annulus 14 above the sealing element 106 into the crossover tool 125 and through the interior bore 121 of the washpipe 120 (as indicated by directional arrow F). This fluid path permits circulation, known as reverse circulation, to remove excess sand slurry left in the washpipe 120 after the gravel pack operation. As opposed to the valve 135 in the position indicated, a valve in another position can be used for similar purposes.

Figure 3:
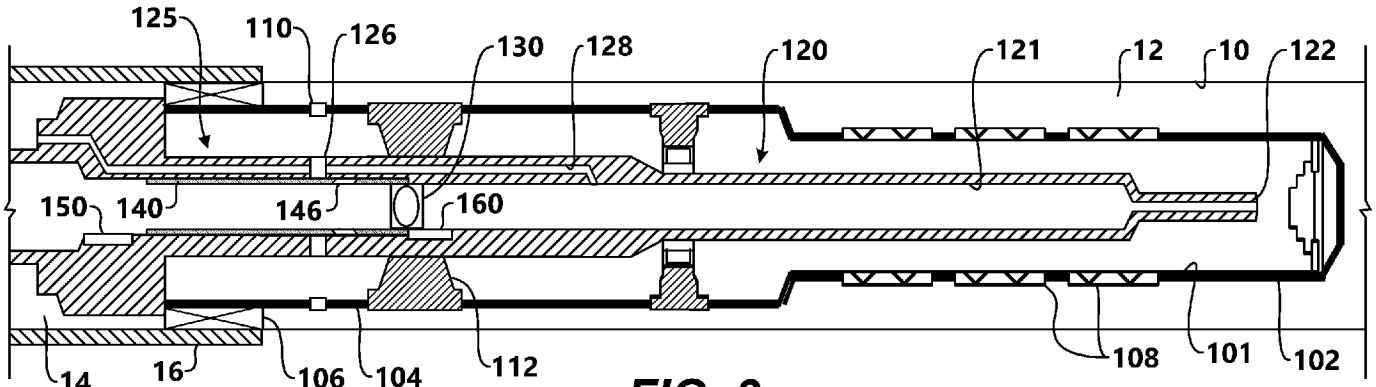
FIG. 3 depicts the crossover of the washpipe tool with the bore valve opened and with the port valve closed.

After the reverse circulating operation is complete, the washpipe tool 120 is reconfigured by sending a third signal to the signal receiver 150 as depicted in FIG. 3. Once the signal receiver 150 receives the proper signal to reconfigure the crossover tool 125, power is supplied by actuator 160 so that the bore valve 130 is moved from the closed condition to an open condition where fluid flow through the interior bore 121 of the washpipe 120 is allowed. Based upon the same or different signal that the signal receiver 150 receives to open the bore valve 130, power is supplied to move the sliding sleeve 140 from its open condition to its closed condition, closing bypass ports 146 to prevent fluid to flow from the interior bore 121 of the washpipe tool 120 into the annular area 12. Moreover, if a recirculation valve (e.g., 135) is used, it too may be closed at this point.

Figure 4:
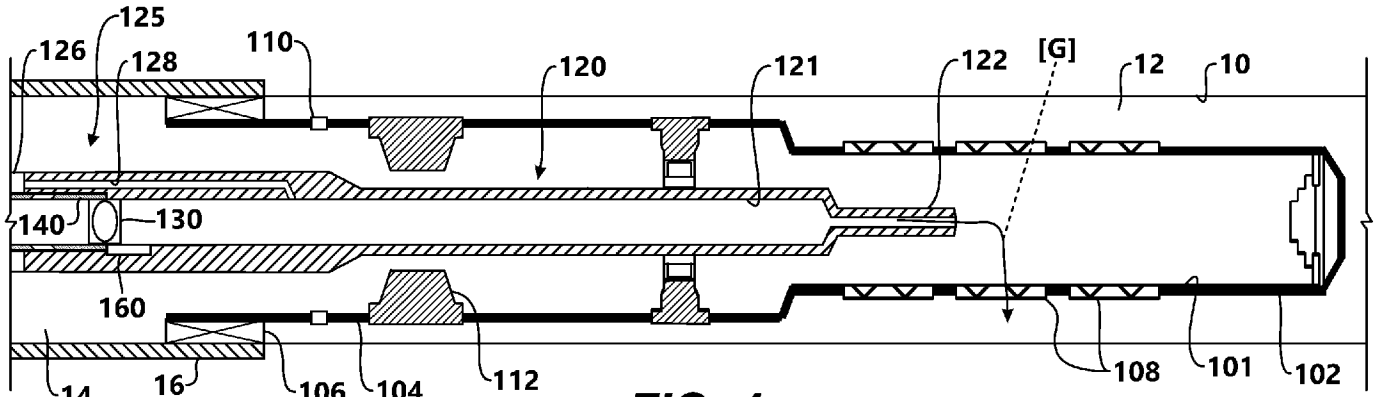
FIG. 4 depicts the washpipe tool relocated in the screen assembly to treat the well.

As now depicted in FIG. 4, once the bore valve 130 is opened and the ports 146 and 126 are closed by the port valve 140, the operator may pump any desired wellbore treatment through the essentially full inner bore 121 of the washpipe 120. As further shown, the operator may reposition the washpipe tool 120 to position the ports 122 near the portion of the screens 108 that the operator desires to treat. Directional arrows G indicate the general direction of the fluid flow for such a treatment operation.

Additional gravel pack valves actuated by RFID or other methods are disclosed in incorporated U.S. application Ser. No. 13/661,710. These other gravel pack valves can be used for any of the various valves (e.g., 130 and 140) disclosed herein. For example, as noted above, the bore valve 130 can be a butterfly valve or a ball valve, although any other type of valve mechanism can be used including a ball and seat mechanism as disclosed in the incorporated U.S. application Ser. No. 13/661,710 and operable via a pressure pulse, RFID device, or other signal.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A gravel packing apparatus for a well having a screen assembly disposed in the well, the screen assembly having an interior, an outlet, and a screen, the apparatus comprising:

a tool having an internal passage and defining first and second ports, the tool positioning in the interior of the screen assembly, the first and second ports configured to communicate the internal passage of the tool with the interior of the screen assembly, the first port placed in communication with the screen, the second port placed in communication with the outlet;

a first valve disposed on the tool and controlling fluid communication through the internal passage;

a second valve disposed on the tool and controlling fluid communication through the second port;

a third valve disposed on the tool and controlling fluid communication directly between first and second points outside the tool on both sides of an intermediate position between the first and second points at which the tool positions in the interior of the screen assembly, the first point being outside the tool and uphole of the interior of the screen assembly, the second point being outside the tool and inside the interior of the screen assembly;

a signal receiver disposed on the tool; and at least one actuator disposed on the tool and operating the first, second, and third valves in response to the signal receiver.

2. The apparatus of claim 1, wherein the at least one actuator comprises a linear or rotary actuator.

3. The apparatus of claim 1, wherein the first valve comprises:

a first rotated position relative to the internal passage of the tool and allowing fluid flow through the internal passage of the tool; and a second rotated position relative to the internal passage of the tool and preventing flow through the internal passage of the tool.

4. The apparatus of claim 1, wherein the first valve comprises a butterfly valve or a ball valve.

5. The apparatus of claim 1, wherein the signal receiver comprises a radio frequency identification device receiver or a pressure pulse receiver.

6. The apparatus of claim 1, wherein the second valve comprises:

a first linear position relative to the internal passage of the tool and preventing fluid flow through the second port in the tool; and a second linear position relative to the internal passage of the tool and allowing fluid flow through the second port in the tool.

7. The apparatus of claim 6, wherein the second valve comprises a sliding sleeve disposed in the internal passage of the tool and movable between the first and second positions, the sliding sleeve in the first position closing the second port, the sliding sleeve in the second position opening the second port.

8. The apparatus of claim 1, wherein the tool comprises a crossover passage communicating the internal passage of the tool downhole of the second port with outside the tool uphole of the second port.

9. The apparatus of claim 1, wherein the tool comprises a first configuration having the first valve opened and having the second valve closed.

10. The apparatus of claim 1, wherein the tool comprises a second configuration having the first valve closed and having the second valve opened.

11. The apparatus of claim 1, wherein the tool in a reverse circulation configuration has the first valve closed, the second valve opened, and the third valve opened, the third valve communicating reverse circulation from outside the tool uphole of the interior of the screen assembly to outside the tool inside the interior of the screen assembly, the second valve communicating the reverse circulation from inside the interior of the screen assembly into the internal passage of the tool.

12. A method of communicating fluid in a well having a screen assembly disposed in the well, the screen assembly having an interior, an outlet, and a screen, the method comprising:

positioning a tool into the interior of the screen assembly, the tool having an internal passage, a first port in communication with the screen, and a second port in communication with the outlet;

communicating one or more signals downhole to the tool; and configuring the tool with the one or more signals by:

actuating a first valve on the tool to control fluid communication through the internal passage of the tool, actuating a second valve on the tool to control fluid communication through the second port in the tool; and actuating a third valve on the tool to control fluid communication directly between first and second points outside the tool on both sides of an intermediate position between the first and second points at which the tool positions in the interior of the screen assembly, the first point being outside the tool and uphole of the interior of the screen assembly, the second point being outside the tool and inside the interior of the screen assembly.

13. The method of claim 12, wherein positioning the tool into the interior of the screen assembly comprises sealing the second port on the tool in fluid communication with the outlet on the screen assembly.

14. The method of claim 12, wherein communicating the one or more signals downhole to the tool comprises communicating the one or more signals with one or more radio frequency identification devices or pressure pulses.

15. The method of claim 12, wherein actuating the first valve on the tool to control fluid communication through the internal passage of the tool comprises preventing fluid flow from the first port through the internal passage by closing the first valve.

16. The method of claim 12, wherein actuating the first valve on the tool to control fluid communication through the internal passage of the tool comprises allowing fluid flow from the first port through the internal passage by opening the first valve.

17. The method of claim 12, wherein actuating the second valve on the tool to control fluid communication through the second port of the tool comprises preventing fluid flow between the internal passage and the second port by closing the second valve.

18. The method of claim 12, wherein actuating the second valve on the tool to control fluid communication through the second port of the tool comprises allowing fluid flow from the internal passage through the second port by opening the second valve.

19. The method of claim 12, further comprising permitting fluid communication of the internal passage downhole of the second port with outside the tool uphole of the second port.

20. The method of claim 12, wherein configuring the tool with the one or more signals comprises configuring the tool for run-in into the screen assembly by actuating the first valve opened, and actuating the second valve closed.

21. The method of claim 12, wherein configuring the tool with the one or more signals comprises configuring the tool for gravel pack in the screen assembly by actuating the first valve closed, and actuating the second valve opened.

22. The method of claim 12, wherein configuring the tool with the one or more signals comprises configuring the tool for reverse circulation by having the first valve closed, the second valve opened, and the third valve opened.

23. The method of claim 22, wherein the method further comprises:

communicating reverse circulation outside the tool uphole of the interior of the screen assembly through the opened third valve to outside the tool inside the interior of the screen assembly, and communicating the reverse circulation from inside the interior of the screen assembly through the opened second valve into the internal passage of the tool.

* * * * *